US005589661A

United States Patent [19]

Menke et al.

[11] Patent Number: 5,589,661

[45] Date of Patent: Dec. 31, 1996

[54] SOLID PROPELLANT BASED ON PHASE-STABILIZED AMMONIUM NITRATE

[75] Inventors: Klaus Menke, Bruchsal; Jutta Bohnlein-Mauss, Speyer; Helmut Schmid; Klaus M. Bucerius, both of Karlsruhe; Walther Engel, Wöschbach, all of Germany

[73] Assignee: Fraunhofer-Gesselschaft zur Forderung der angewandten Forschung e.V., Munich, Germany

[21] Appl. No.: 536,640

[22] Filed: Sep. 29, 1995

[30] Foreign Application Priority Data

Oct. 5, 1994 [DE] Germany ..... 44 35 523.8

[51] Int. Cl.[6] ..... C06B 45/10

[52] U.S. Cl. ..... 149/19.4; 149/19.1; 149/19.6

[58] Field of Search ..... 149/19.1, 19.4, 149/19.6

[56] References Cited

U.S. PATENT DOCUMENTS

| | | | |
|---|---|---|---|
| 3,340,111 | 9/1967 | Stammler | 149/19.4 |
| 3,609,115 | 9/1971 | Sammons et al. | 149/19.1 |
| 3,629,019 | 12/1971 | Lawrence | 149/19.5 |
| 3,822,154 | 7/1974 | Lawrence et al. | 149/19.4 |
| 3,924,405 | 12/1975 | Cohen et al. | 149/19.1 |
| 4,158,583 | 6/1979 | Frosch | 149/19.4 |
| 4,166,045 | 8/1979 | Rudy et al. | 149/19.4 |
| 4,318,270 | 3/1982 | Orlick et al. | 149/19.1 |
| 4,411,717 | 10/1983 | Anderson | 149/19.4 |
| 5,074,938 | 12/1991 | Chi | 149/19.4 |
| 5,076,868 | 12/1991 | Doll et al. | 149/19.4 |
| 5,292,387 | 3/1994 | Highsmith et al. | 149/19.91 |

FOREIGN PATENT DOCUMENTS 0584899 3/1994 European Pat. Off. .

*Primary Examiner*—Edward A. Miller
*Attorney, Agent, or Firm*—Antonelli, Terry, Stout & Kraus

[57] ABSTRACT

A solid propellant for rocket propulsion systems or gas generators comprises 35 to 80 wt. % ammonium nitrate (AN) with an average particle size of 5 to 200 μm, which is phase-stabilized (PSAN) by chemical reaction with CuO or ZnO, 15 to 50 wt. % of a binder system of a binder polymer and an energy-rich plasticizer, as well as 0.2 to 5.0 wt. % of a burning moderator of vanadium/molybdenum oxide as an oxide mixture or mixed oxide.

23 Claims, 2 Drawing Sheets

Burning behaviour of Cu-PSAN and Zn-PSAN/GAP-propellants with V/Mo-Oxid as burning catalysts

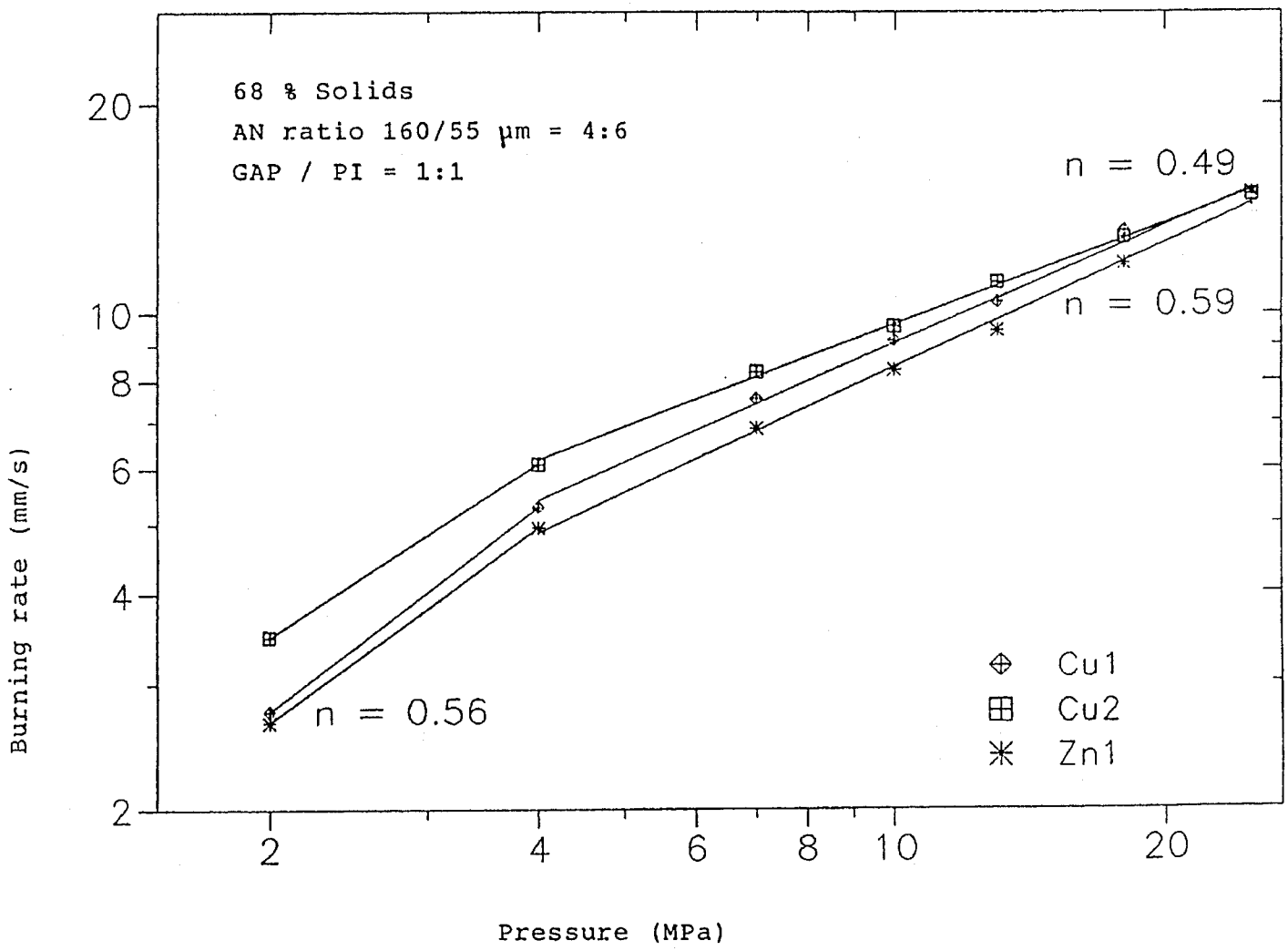
Fig. 1: Burning behaviour of Cu-PSAN and Zn-PSAN/GAP-propellants with V/Mo-Oxid as burning catalysts

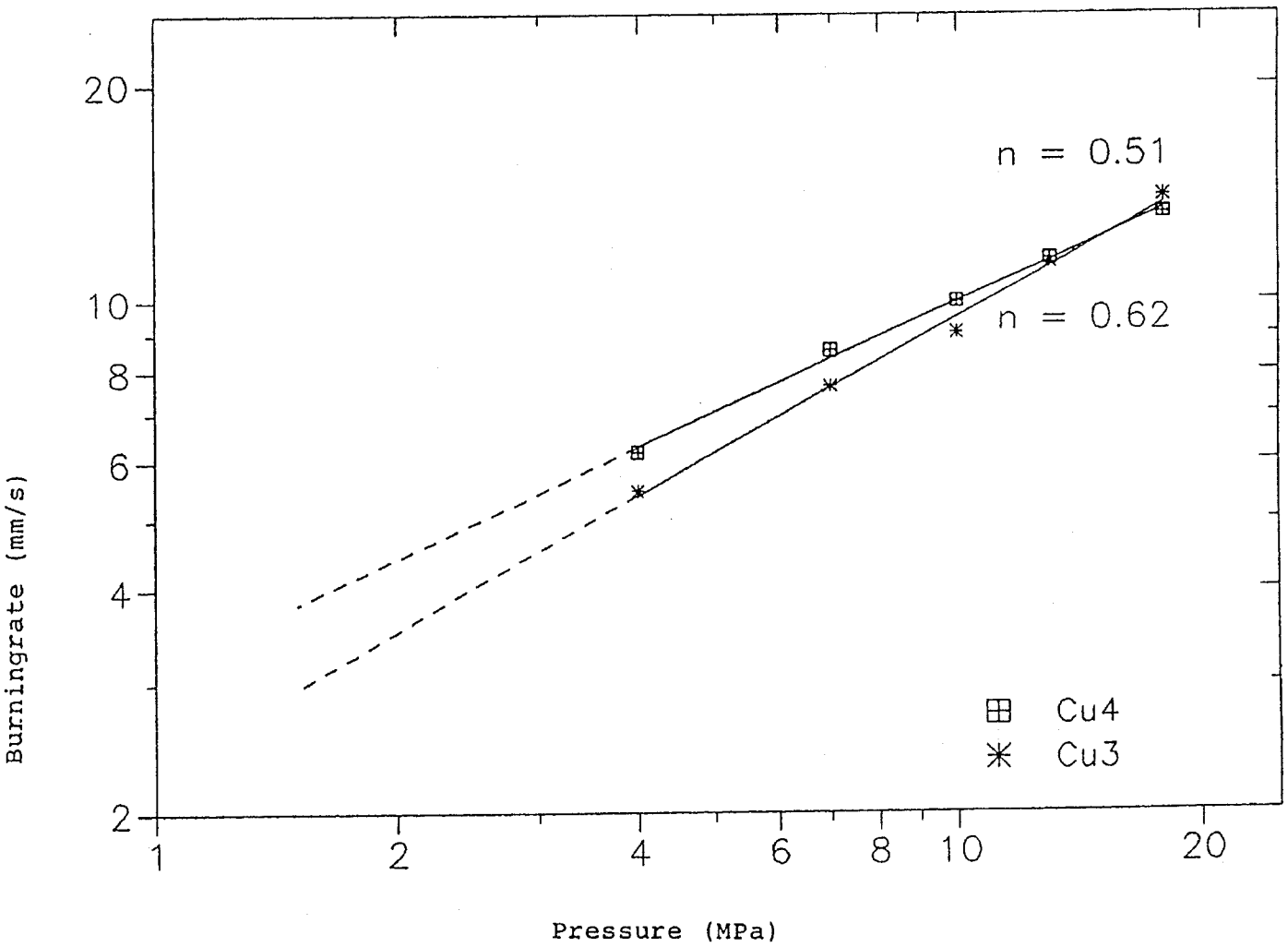
Fig. 2: Burning Behaviour of Cu-PSAN-propellants with high (Cu3) and low (Cu4) amount of Nitratester-plastiziser

SOLID PROPELLANT BASED ON PHASE-STABILIZED AMMONIUM NITRATE

FIELD OF THE INVENTION

The invention relates to a solid propellant for rocket propulsion systems or gas generators containing as the oxidizer phase-stabilized ammonium nitrate.

BACKGROUND OF THE INVENTION

Solid propellants of the aforementioned type generally have a low burning speed and a high pressure exponent. The burning speed or rate can be increased by adding solid, high-energy substances such as octogen (HMX) or hexogen (RDX), or metals having a high heat of combustion, such as aluminium or boron. Combinations with energy-rich binders serve the same function. These include isocyanate-bound glycidylazido polymers (GAP), nitrate ester-containing polymers, such as polyglycidyl nitrate and polynitratomethylethyloxetan or nitro-amino-substituted polymers. Even though this leads to a rise in the burning rate, the pressure exponent and the temperature coefficient are only slightly or not reduced.

Additions of ammonium perchlorate, which lead to a rise in the burning speed, admittedly reduce with a higher dosage the pressure exponent, but lead to the formation of hydrochloric acid in the exhaust and therefore to higher smoke formation with high atmospheric humidity.

In the case of double base and composite double base solid propellants the burning behaviour can be favourably influenced by adding lead and copper salts or oxides in conjunction with carbon black, but said additives can only be used to a limited extent in the case of ammonium nitrate-containing propellants. Said salts and oxides mainly act in the sense of increasing the burning rate, but do not allow an adequate drop of the pressure exponent.

The problem of the invention is to improve the burning behaviour of solid propellants based on pure and phase-stabilized ammonium nitrate.

SUMMARY OF THE INVENTION

According to the invention such a solid propellant comprises 35 to 80 wt. % ammonium nitrate (AN) with an average particle size of 5 to 200 μm, phase-stabilized by chemical reaction with CuO or ZnO (PSAN), 15 to 50 wt. % of a binder system of a binder polymer and an energy-rich plasticizer, as well as 0.2 to 5.0 wt. % of a burning moderator of vanadium/molybdenum oxide as an oxide mixture of mixed oxide.

Solid propellants with this formulation have a very favourable burning behaviour. As a function of the composition it is possible to attain burning rates above 8 mm/s at normal temperature and a combustion chamber pressure of 10 MPa. In the range 4 to 25 MPa, optionally 7 to 25 MPa, the pressure exponent reaches values of n ¾ 0.6 and in the most favourable case n ¾ 0.5. This burning behaviour gives the solid propellant with the composition according to the invention a particular suitability for use in flying objects of the tactical or strategic rocket defence.

The solid propellants according to the invention are initially characterized by an oxidizer constituted by phase-stabilized ammonium nitrate reacted with copper oxide or zinc oxide, the metal oxides preferably being used in a proportion of 1 to 7 wt. %. They stabilize the crystal phases of AN and suppress larger volume changes of the particle size in the temperature range −40° to +70° C. The incorporation into the AN crystal matrix takes place by means of a chemical reaction of copper or zinc oxide with the melt of the pure ammonium nitrate, accompanied by dehydration. The most favourable particle shape for producing the propellant can then be obtained by spraying the melt and rapid cooling in a cold, cyclon-like guided air flow.

The burning behaviour is decisively influenced by the particle size of the phase-stabilized ammonium nitrate. Preference is given to a fine crystalline form with an average particle size of 5 to 200 μm with a proportion of 35 to 80 wt. % in the propellant. Particularly favourable burning values are obtained if the AN fraction is preponderantly present in the smaller particle size of 5 to 80 μm and less in the average particle size of 100 to 160 μm.

BRIEF DESCRIPTION OF THE DRAWINGS

FIGS. 1–2 are graphs showing burning rate exponent vs. pressure curves of propellants according to the invention.

The solid propellant according to the invention can also contain energy-rich substances, particularly nitramines, such as hexogen (RDX) or octogen (HMX) with an average particle size of 2 to 20 μm and with a proportion of 1 to 20 wt. %.

It is also possible to use 0.5 to 20 wt. % metals, such as aluminium, magnesium or boron in the propellant and a particle size of 0.1 to 50 μm is recommended.

To give the propellant an adequate chemical stability, stabilizers are advantageously added thereto and they act as nitrogen oxide and acid traps. They are preferably constituted by diphenyl amine, 2-nitrodiphenyl amine, and N-methyl nitroaniline, which can in each case be used alone or in combination with one another in concentrations of 0.4 to 2 wt. %. Particularly in the case of nitric acid-containing propellants they can in particular be combined with small amounts of approximately 0.5 wt. % magnesium oxide acting in the same way.

The burning moderators are preferably used as mixed oxides, in which are present molybdenum of oxidation stage +VI and vanadium of oxidation stages +IV and +V. Exemplified compositions of the mixed oxides are $V_6Mo_4O_{25}$ and $V_6Mo_{15}O_{60}$.

The burning moderators can also have as the carrier material chromium (III) or titanium (IV) oxides.

The burning moderators used in a proportion of 0.2 to 5.0 wt. % according to the invention are advantageously added with carbon black or graphite in a proportion of 5 to 50 wt. % to the burning moderator fraction.

A further essential constituent in concentrations of 15 to 50 wt. % is a binder system consisting of a binder polymer and an energy-rich plasticizer. The binder polymer can be inert and is preferably in the form of isocyanate-hardening, bifunctional or trifunctional, hydroxy-substituted polyester or polyether prepolymers. Instead of these it is also possible to use energy-rich polymers, preferably isocyanate-hardening, difunctional or trifunctional, hydroxy-substituted glycidylazido polymers.

The energy-rich plasticizers are preferably chosen from the group of chemically stable nitrate esters, nitro, nitroamino or azido plasticizers.

The nitrate esters used are in particular trimethylol ethane trinitrate, (TMETN), butane triol trinitrate (BTTN) or diethylene glycol dinitrate (DEGDN).

An example for a nitroplasticizer is a 1:1 mixture of bis dinitropropyl formal/acetal (BDNPF/A). An example of a nitroamino plasticizer is a 1:1 mixture of N-ethyl and N-methyl nitratoethyl nitroamine (EtNENA, MeNENA) or N-n-butyl-N-nitratoethyl nitroamine (BuNENA) or N,N'-dinitratoethyl nitroamine (DINA). As an azido plasticizer can in particular be used short-chain, bis azido-terminated GAP oligomers (GAP-A) or 1,5-diazido-3-nitroamlnopentane (DANPE).

As a function of the content, compatibility and energy of the binder components the polymer/plasticizer ratio is 1:3 to 20:1 wt. %. Obviously the binder polymers can also be used in pure form.

To the phase-stabilized ammonium nitrate are preferably added 0.1 to 1 wt. % anticaking agent, e.g. ultrafine (particle size approx. 0.02 μm) silica gel, sodium lauryl sulphonate, tricalcium phosphate or other surfactants.

According to the invention the vanadium/molybdenum oxide burning moderators are ideally combined with copper salts, oxides or complexes, which leads to a further rise in the burning rate, particularly in the low pressure range, associated with a further reduction of the pressure exponent.

The burning behaviour is particularly favourably influenced by the use of the copper oxide-stabilized ammonium nitrate combined with vanadium/molybdenum oxides. In the case of the additive of 2 to 7 wt. % of phase-stabilized Cu0 according to the invention, there is a much higher burning rate and lower pressure exponent. This favourable burning behaviour is in particular encountered with solid propellants, whose binder contains up to 50% azido compounds in the form of high-energy polymers and/or plasticizers.

According to another preferred development, the burning moderators have a particle size of 1 to 60 μm, preferably 1 to 10 μm and a high inner surface of 5 to 100 $m^2/g$, preferably 20 to 60 $m^2/g$.

Metal-free solid propellants of the described type are suitable as a result of their energy content, low-smoke, hydrochloric acid-free burning and comparatively low, mechanical and detonative sensitivity are suitable for use in rocket engines, whereas lower energy formulations with a higher binder proportion are suitable for use as gas generator charges.

When the described solid propellants are used in rocket engines to them are advantageously added as further additives high-melting metal carbides or nitrates, preferably silicon and/or zirconium carbide with a concentration of 0.1 to 1 wt. %. In the formulation according to the invention without an addition of metal, said additives ensure the suppression of unstable oscillations in the burning behaviour.

EXAMPLE

Table 1 shows in its upper part five different formulations for ammonium nitrate, which is phase-stabilized with copper oxide or zinc oxide (PSAN). For the individual formulations the lower part of the table shows the burning rate r (mm/s) at 20° C. and for three different combustion chamber pressures and below same is the pressure exponent n for different pressure ranges in brackets.

The comparison of formulation Cu1 and Cu2 shows how with an ever smaller particle size the action of the burning moderator is clearly improved in the sense of a rise in the burning rate and a fall in the pressure exponent. However, the conditions deteriorate if, as in the case of Cu3, the proportion of high-energy nitrate ester plasticizer exceeds the GAP proportion of the binder. This is particularly noticeable with the pressure exponent. Cu4 illustrates the burning-increasing action of additionally added copper oxide. Finally, Zn1 shows for the same particle size of the PSAN, that with vanadium/molybdenum oxide burning moderators, even without copper compounds, it is possible to attain pressure exponents n ¾ 0.6 and burning rates r>8 mm/s at a 10 MPa combustion chamber pressure.

In the diagram or graph according to FIG. 1 the burning behaviour of the formulations Cu1, Cu2 and Zn1 are shown as a function 1 gr=f(1gp) for a propellant with a 60% solids proportion, an ammonium nitrate with a particle size ratio 160/55 μm of 4:6 and a binder system GAP (glycidyl azido polymer/P1 plasticizer). This clearly shows the favourable influence on the burning rate of the smaller particle size (Cu2 compared with Cu1) accompanied by a simultaneous drop of the pressure exponent from n=0.56 to n=0.49. A still passable burning rate is achieved for Zn1 with a pressure exponent which is still below 0.6.

The diagram or graph of FIG. 2 shows the same dependencies for Cu3 with a high and Cu4 with a low proportion of nitrate ester plasticizer. The more favourable values for Cu4 with respect to both the burning rate and the pressure exponent are very obvious.

TABLE 1

PROPELLANT FORMULATIONS AND BURNING CHARACTERISTICS

| | Cu1 | Cu2 | Cu3 | Cu4 | Zn1 |
|---|---|---|---|---|---|
| Cu PSAN 3. CuO 160 um | 42 | 22 | 22 | 22 | — |
| Cu PSAN 3% CuO 55 um | 18 | 33 | 33 | 33 | — |
| Zn PSAN 3% ZnO 160 um | — | — | — | — | 22 |
| Zn PSAN 3% ZnO 55 um | — | — | — | — | 33 |
| RDX 5 um | 10 | 10 | 10 | 10 | 10 |
| GAP/N100 | 16.5 | 16 | 10 | 16 | 16 |
| TMETN | 10 | 15.5 | 7.5 | 15.5 | 15.5 |
| BTTN | — | — | 14 | — | — |
| DPA | 0.5 | 0.5 | 0.5 | 0.5 | 0.5 |
| Cu-oxide | — | — | — | 1 | — |
| V/Mo-oxide | 2.5 | 2.5 | 2.5 | 1.5 | 2.5 |
| Carbon black | 0.5 | 0.5 | 0.5 | 0.5 | 0.5 |
| Burning rate at 20° C. (mm/s) | | | | | |
| $r_2$ MPA | 2.8 | 3.5 | 3.4 | 4.3 | 2.7 |
| $r_7$ MPA | 7.6 | 8.3 | 7.7 | 8.6 | 6.9 |
| $r_{10}$ MPA | 9.2 | 9.6 | 9.6 | 10.0 | 8.3 |
| Pressure exponent n (range MPa) | 0.57 (4–25) | 0.48 (4–25) | 0.62 (4–18) | 0.51 (4–18) | 0.59 (4–25) |
| | 0.95 (2–4) | 0.80 (2–4) | | | 0.90 (2–4) |

What is claimed is:

1. Solid propellant for rocket propulsion systems or gas generators, comprising 35 to 80 wt. % ammonium nitrate (AN) with an average particle size of 5 to 200 μm, which is phase-stabilized (PSAN) by chemical reaction with Cu0 or Zn0, 15 to 50 wt. % of a binder system of a binder polymer and an energy-rich plasticizer, as well as 0.2 to 5.0 wt. % of a burning moderator of vanadium oxide/molybdenum oxide as an oxide mixture or mixed oxide.

2. Solid propellant according to claim 1, wherein the proportion of phase-stabilized Cu0 or Zn0 amounts to 1 to 7 wt. % of the ammonium nitrate fraction and is incorporated into the AN crystal matrix by chemical reaction with the AN melt, accompanied by dehydration.

3. Solid propellant according to claim 1 with a further proportion of 1 to 20 wt. % energy-rich nitramines, selected from among hexogen and octogen, with an average particle size of 1 to 20 μm.

4. Solid propellant according to claim 1, with a further proportion of 0.5 to 20 wt. % metals, selected from among alumlnlum, magnesium and boron, with a particle size 0.1 to 50 μm.

5. Solid propellant according to claim 1 with a further proportion of 0.4 to 2 wt. % of a stabilizer, acting as a nitrogen oxide and acid trap, of diphenyl amine, 2-nitrodiphenyl amine or N-methyl nitroaniline or a combination thereof.

6. Solid propellant according to claim 1 with an addition of carbon black or graphite with 5 to 50 wt. % of the burning moderator fraction.

7. Solid propellant according to claim 1, wherein the binder polymer is an isocyanate-hardening, bifunctional or trifunctional, hydroxy-substituted polyester or pollyether prepolymer.

8. Solid propellant according to claim 1, wherein the binder polymer is an energy-rich polymer.

9. Solid propellant according to claim 8, wherein the energy-rich polymer is an isocyanate-hardening, bifunctional or trifunctional, hydroxy-substituted glycidyl azido polymer (GAP).

10. Solid propellant according to claim 1, wherein the energy-rich plasticizer is chosen from the group of chemically stable nitrate esters, nitro, nitroamino or azido plasticizers.

11. Solid propellant according to claim 10, wherein the nitrate ester is a trimethylol ethane trinitrate (TMETN), butane triol trinitrate (BTTN) or diethylene glycol dinitrate (DEGDN).

12. Solid propellant according to claims 10, wherein the nitro plasticizer is a 1:1 mixture of bis dinitropropyl formal/bis dinitropropyl acetal (BDNPF/BDNPA).

13. Solid propellant according to claim 10, wherein the nitro amino plasticizer is a 1:1 mixture of N-ethyl and N-methyl nitratoethyl nitroamine (EtNENA and MeNENA) or N-n-butyl-N-nitratoethyl nitroamine (BuNENA) or N,N'-dinatratoethyl nitroamine (DINA).

14. Solid propellant according to claim 10, wherein the azido plasticizer comprises short-chain GAP oligomers (GAP-A) with terminal bis azido groups or 1,5-diazido-3-nitroaminopentane (DANPE).

15. Solid propellant according to claim 1, characterized in that the binder polymers and plasticizers are present as a function of the nature, compatibility and energy content in the binder system in a ratio of 1:3 to 3:1 wt. %.

16. Solid propellant according to claim 1, wherein the average PSAN particle size is between 5 and 80 μm.

17. Solid propellant according to claims 1, wherein to the PSAN are added 0.1 to 1 wt. % of its fraction of ultrafine silica gel (particle size approx. 0.02 μm), sodium lauryl sulphonate, tricalcium phosphate or other surfactants as anticaking agents.

18. Solid propellant according to claim 1, wherein the vanadium oxide/molybdenum oxide burning moderators are used in conjunction with Cu salts, oxides or complexes.

19. Solid propellant according to claim 1, wherein the burning moderators contain mixed oxides of molybdenum of oxidation stage +VI and vanadium of oxidation stages +IV and +V.

20. Solid propellant according to claim 1, wherein the burning moderators have as the carrier material chromium (III) or titanium (IV) oxides.

21. Solid propellant according to claim 1, characterized in that the burning moderators have a particle size of 1 to 60 μm, preferably 1 to 10 μm, and a large inner surface of 5 to 100 $m^2/g$, preferably 20 to 60 $m^2/g$.

22. Solid propellant according to claim 1, characterized in that the latter when used in rocket engines contains 0.1 to 1 wt. % of high-melting metal carbides or nitrides as additives for suppressing an unstable, oscillating burning behaviour.

23. Solid propellant according to claim 22, characterized in that the additives are silicon and/or zirconium carbide.

* * * * *